United States Patent [19]

Black et al.

[11] 3,997,986

[45] Dec. 21, 1976

[54] GUARD FOR HYDRAULIC CYLINDER RODS

[75] Inventors: William J. Black, Wilmington; Eugene M. Wilson, Joliet, both of Ill.

[73] Assignee: Caterpillar Tractor Co., Peoria, Ill.

[22] Filed: Oct. 9, 1975

[21] Appl. No.: 620,997

[52] U.S. Cl. ..... 37/8; 37/129

[51] Int. Cl.[2] ..... E02F 9/24

[58] Field of Search ..... 37/8, 124, 126 R, 126 A, 37/126 AA, 126 AB, 126 AC, 126 AD, 126 AE, 129; 214/131

[56] References Cited

UNITED STATES PATENTS

| | | | |
|---|---|---|---|
| 2,764,303 | 9/1956 | Austin, Sr. | 214/131 |
| 3,048,934 | 8/1962 | Hancock | 37/8 |
| 3,108,388 | 10/1963 | Johnson | 37/8 X |
| 3,314,176 | 4/1967 | Jones | 37/129 |
| 3,474,547 | 10/1969 | Campbell et al. | 37/8 |

*Primary Examiner*—E. H. Eickholt
*Attorney, Agent, or Firm*—John W. Grant

[57] ABSTRACT

A guard is removably secured to the sidewall at the leading edge of an open-ended scraper bowl of a self-loading scraper and extends inwardly towards an elevator mechanism centrally disposed at the open end of the scraper bowl. The guard is disposed rearwardly of a rod of a hydraulic lift cylinder for shielding the rod from loose noncohesive material in the scraper bowl and for aiding in the retention of such material in the scraper bowl.

3 Claims, 4 Drawing Figures

GUARD FOR HYDRAULIC CYLINDER RODS

BACKGROUND OF THE INVENTION

This invention relates to a guard for hydraulic cylinder rods and more particularly to a guard for shielding the hydraulic lift cylinder rod of a self-loading scraper from abrasive material in the scraper bowl.

Self-loading elevating scrapers commonly have an elevator mechanism disposed at the forward end of an open-ended scraper bowl with the elevator centered between the leading edges of the sidewalls. The elevational positions of the forward end of the scraper bowl are controlled by a pair of hydraulic jacks disposed on opposite sides of the elevator mechanism. The mere proximity of the elevator mechanism to the sidewalls is relied upon to retain the material being loaded within the scraper bowl. Since the elevator mechanism is not in positive contact with the sidewalls, a problem arises when loading loose, noncohesive material such as sandy or rocky soil. Some of such material tends to sift or spill out between the elevator and the sidewalls and against the unprotected rod of the lift jacks. The rods of hydraulic jacks are normally highly polished and the abrasive action of the sandy material causes deterioration of the surface finish of the rod leading to premature fluid leakage around the rod seal. Also, sandy soil works in around the pivot pin and the eye of the rod causing undue wear to the pivotal connection.

OBJECTS OF THE INVENTION

Accordingly, an object of this invention is to provide an improved guard for shielding a rod of a hydraulic lift cylinder from sandy and rocky soil falling from a scraper bowl of an elevating scraper.

Another object of this invention is to provide such an improved guard which aids in retaining loose noncohesive soil in the scraper bowl of an elevating scraper.

Another object of this invention is to provide an improved guard of the character described which is readily removable when the scraper is utilized for loading cohesive material.

Other objects and advantages of the present invention will become more readily apparent upon reference to the accompanying drawings and following description.

DESCRIPTION OF THE PREFERRED EMBODIMENT

Figure 1:
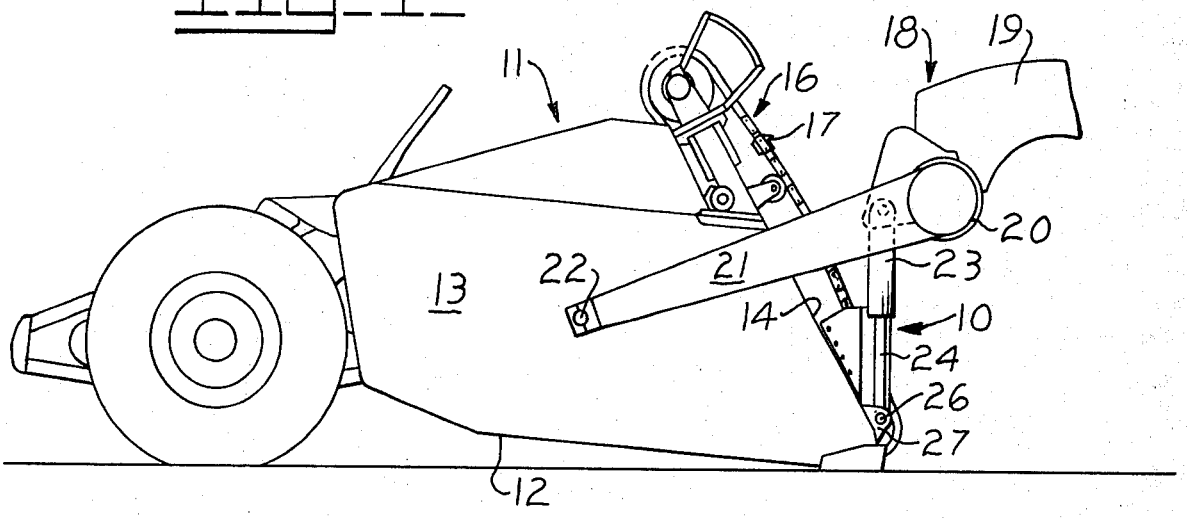
FIG. 1 is a side elevational view of a self-loading scraper to which the guard for hydraulic cylinder rods embodying the principles of the present invention is removably attached.
Figure 2:
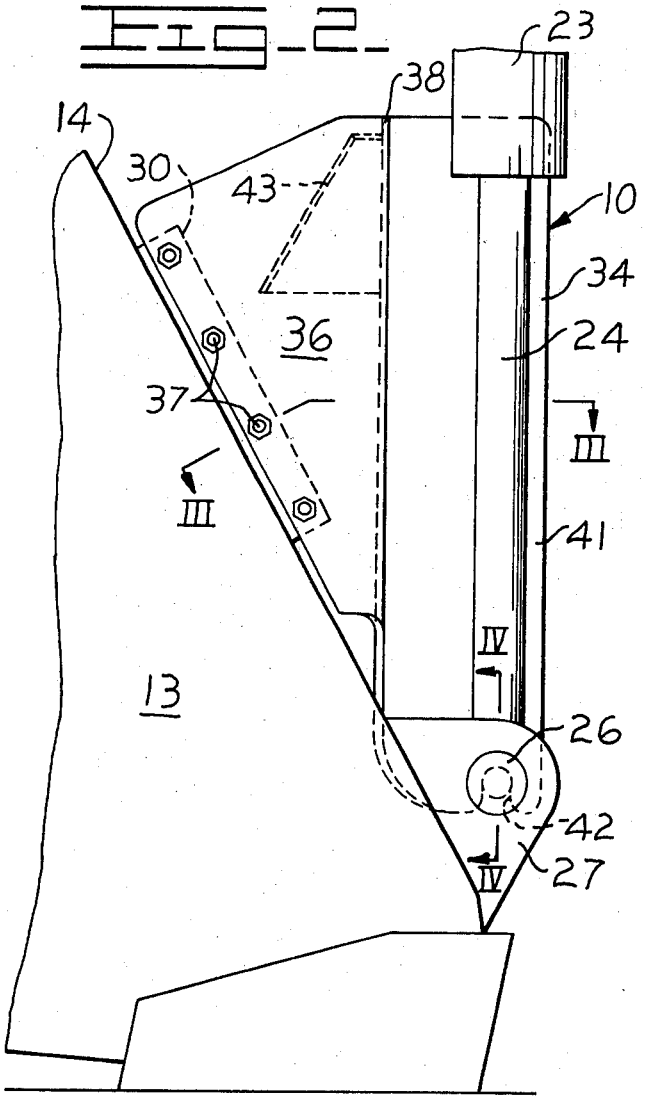
FIG. 2 is an enlarged side elevational view of the guard.
Figure 3:
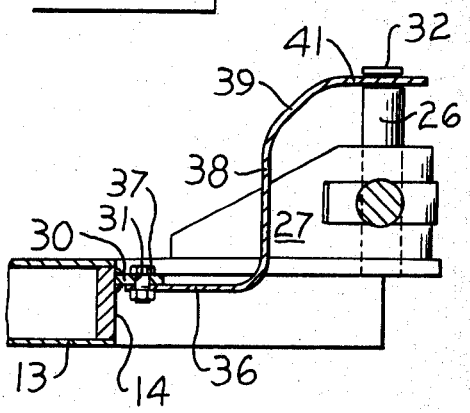
FIG. 3 is a cross sectional view taken along line III—III of FIG. 2.
Figure 4:
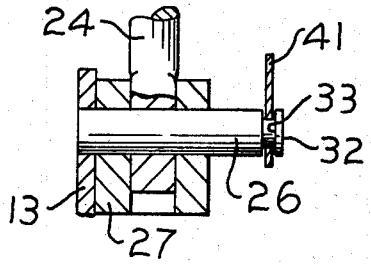
FIG. 4 is a sectional view taken along line IV—IV of FIG. 3.

Referring now to the drawing, a guard for hydraulic cylinder rods embodying the principles of the present invention is generally indicated by the reference numeral 10 operatively associated with a self-loading scraper 11. The self-loading scraper typically includes a scraper bowl assembly 12 open at its forward end and having a pair of sidewalls, one of which is shown at 13.

Each sidewall has a leading edge 14 extending upwardly and rearwardly from the lower forward corner thereof. An elevator mechanism 16 is suitably mounted at the open end of the scraper bowl assembly between the leading edges of the sidewalls for assisting in loading material into the scraper bowl. The elevator mechanism has its lower end adjacent to the cutting edge, not shown, and includes a continuous track of elevator flights, one shown at 17, disposed for clockwise rotation. The elevator mechanism is generally centered between the sidewalls leaving a space, not shown, between the ends of the flights and the sidewalls.

The scraper bowl 12 is connected to a tractor through a draft apparatus 18 which includes a gooseneck partially shown at 19, a transversely disposed draft tube 20 integrally secured to the gooseneck, and a pair of draft arms, one shown at 21, which are secured to the opposite ends of the draft tube and extend rearwardly therefrom. The distal end of each draft arm is pivotally connected at 22 to the sidewalls of the scraper bowl rearwardly of the leading edge 14. A pair of hydraulic lift cylinders, one shown at 23, are pivotally secured to the rearward side of the draft tube adjacent to the draft arms and extend downwardly therefrom. A rod 24 of each hydraulic cylinder is pivotally connected by a pivot pin 26 to a bifurcated bracket 27 which is secured to the lower inner surface of the sidewall adjacent to the leading edge.

A mounting strip 30 is secured, as by welding, to the leading edge 14 of each sidewall 13 and is transpierced by a plurality of holes 31. An end 32 of the pivot pin 26 extends inwardly beyond the mounting bracket 27 and has an annular groove 33 formed therein.

The guard 10 of the present invention is provided in pairs with each guard removably secured to a respective sidewall. Each guard includes a formed plate 34 having a triangular-shaped first portion 36 disposed in a plane parallel to the sidewalls and secured to the mounting strip 30 by a plurality of bolts 37, a second portion 38 extending inwardly from the first portion toward the elevator mechanism 16 and disposed rearwardly of the rod 24 of the hydraulic cylinder 23, a third portion 39 angled forwardly from the second portion and a fourth portion 41 which extends forwardly from the third portion in a plane substantially parallel to the first portion and is disposed between the rod and the elevator mechanism. A notch 42 is formed in the lower edge of the fourth portion and fits within the annular groove 33 of the pivot pin 26 and cooperates with the bolts for attaching the guard to the scraper bowl. A reinforcement plate 43 is secured as by welding to the first and second portions.

In view of the foregoing, it is readily apparent that the structure of the present invention provides an improved guard for hydraulic cylinder rods for preventing loose noncohesive material from falling from the scraper bowl against the rod of the hydraulic lift cylinder of an elevating scraper. The guard reduces the clearance between the elevator mechanism and the sidewalls and thereby aids in retaining the loose material in the scraper bowl both during loading and when transporting materials to a dump sight. Further, since the inner portion of the guard is notched to seat in an annular groove in the pivot pin connecting the rod to the sidewalls, and the retaining bolts are readily accessible, the guard may be readily removed when loading cohesive material.

While the invention has been described and shown with particular reference to the preferred embodiment, it will be apparent that variations might be possible that would fall within the scope of the present invention which is not intended to be limited except as defined in the following claims.

What is claimed is:

1. In a self-loading scraper of the type having a scraper bowl open at its forward end and including a pair of sidewalls each having an upwardly rearwardly sloping leading edge, an elevator mechanism disposed at the open end of the scraper bowl and between the leading edges, a draft apparatus having a pair of rearwardly extending draft arms with the distal ends of the draft arms individually pivotally attached to the sidewalls, a pair of hydraulic lift cylinders pivotally connected to the draft apparatus and having their rods pivotally connected to the lower forward corners of the sidewalls, wherein the improvement comprises:

a guard removably secured to the lower forward corner of one of the sidewalls at the leading edge thereof and extending inwardly toward the elevator mechanism, said guard being disposed rearwardly of the rod of the respective hydraulic lift cylinder for shielding the rod from loose noncohesive material in the scraper bowl and for aiding in the retention of such material in the scraper bowl; and a pin pivotally connecting the rod of each hydraulic cylinder to the respective sidewall, said pin having an annular groove formed in one end thereof, said guard having a notch formed therein fitted into the annular groove of the pin.

2. The guard of claim 1 including a formed plate having a first portion secured to said mounting strip and disposed in a plane substantially parallel to the sidewall, a second portion extending inwardly from said second portion and toward the elevator mechanism and disposed rearwardly of the rod, a third portion angled inwardly and forwardly from the third portion, and a fourth portion extending forwardly from said third portion in a plane substantially parallel to the first portion and disposed between the rod and the elevator mechanism, said notch being formed at the lower edge of said fourth portion.

3. In a self-loading scraper of the type having a scraper bowl open at its forward end and including a pair of sidewalls each having an upwardly, rearwardly sloping leading edge, an elevator mechanism disposed at the open end of the scraper bowl and between the leading edges, a draft apparatus having a pair of rearwardly extending draft arms with the distal ends of the draft arms individually pivotally attached to the sidewalls, a pair of hydraulic lift cylinders pivotally connected to the draft apparatus, and a pair of pivot pins pivotally connecting the rod of the lift cylinders to the respective lower forward corners of the sidewalls, the improvement comprising:

a guard removably secured to the lower forward corner of one of the side walls at the leading edge thereof and extending inwardly toward the elevator mechanism, said guard being disposed rearwardly of the rod of the respective hydraulic lift cylinder for shielding the rod from loose noncohesive material in the scraper bowl and for aiding in the retention of such material in the scraper bowl, the guard having a lower portion disposed adjacent an end of one of the pivot pins; and means for removably attaching the lower portion of the guard to said end of the one pivot pin.

* * * * *